US010577917B2

(12) United States Patent
Marshall

(10) Patent No.: US 10,577,917 B2
(45) Date of Patent: Mar. 3, 2020

(54) DOWNHOLE DRILL BIT CHASSIS

(71) Applicant: Novatek IP, LLC, Provo, UT (US)

(72) Inventor: Jonathan D. Marshall, Mapleton, UT (US)

(73) Assignee: NOVATEK IP, LLC, Provo, UT (US)

( * ) Notice: Subject to any disclaimer, the term of this patent is extended or adjusted under 35 U.S.C. 154(b) by 11 days.

(21) Appl. No.: 15/944,605

(22) Filed: Apr. 3, 2018

(65) Prior Publication Data

US 2019/0301274 A1 Oct. 3, 2019

(51) Int. Cl.

| | |
|---|---|
| ***E21B 10/62*** | (2006.01) |
| ***E21B 17/02*** | (2006.01) |
| ***E21B 47/01*** | (2012.01) |

(52) U.S. Cl.

CPC ..... *E21B 47/011* (2013.01); *E21B 10/62* (2013.01); *E21B 17/02* (2013.01)

(58) Field of Classification Search

CPC ..... E21B 47/011; E21B 10/62; E21B 17/02
See application file for complete search history.

(56) References Cited

U.S. PATENT DOCUMENTS

| | | | | |
|---|---|---|---|---|
| 8,141,657 | B2 | 3/2012 | Hutton | |
| 8,727,036 | B2 | 5/2014 | Johnson et al. | |
| 8,757,294 | B2 | 6/2014 | Johnson et al. | |
| 8,763,726 | B2 | 7/2014 | Johnson et al. | |
| 8,931,548 | B2 * | 1/2015 | Partouche | E21B 17/02 166/242.6 |
| 9,255,450 | B2 | 2/2016 | Jain et al. | |
| 9,279,293 | B2 | 3/2016 | Izbinski | |
| 9,708,859 | B2 | 7/2017 | Jain et al. | |
| 2016/0053551 | A1 | 2/2016 | Jain et al. | |
| 2017/0175455 | A1 | 6/2017 | Jain et al. | |
| 2017/0350197 | A1 * | 12/2017 | Sugiura | E21B 47/12 |
| 2018/0038171 | A1 * | 2/2018 | Hall | E21B 17/028 |

* cited by examiner

*Primary Examiner* — Nicole Coy
*Assistant Examiner* — Yanick A Akaragwe
(74) *Attorney, Agent, or Firm* — Philip W. Townsend, III

(57) ABSTRACT

A drill bit assembly, of a type useful for forming a borehole in the earth, may comprise a chassis, separate from a drill bit, housed within a cavity of the drill bit. A drill string may be secured to the drill bit and retain the chassis within the cavity. This chassis may comprise two pairs of interfacing exchange surfaces, a first pair disposed between the chassis and the drill string and a second pair disposed between the chassis and the drill bit. Both of the first pair are annular in shape and fixed together independent of rotational orientation. The second pair are fixed together in a specific rotational orientation. These pairs of interfacing exchange surfaces may allow for various types of signals, such as electrical, hydraulic, optical or electromagnetic for example, to be exchanged and passed through the chassis or to electronics disposed on the chassis.

19 Claims, 5 Drawing Sheets

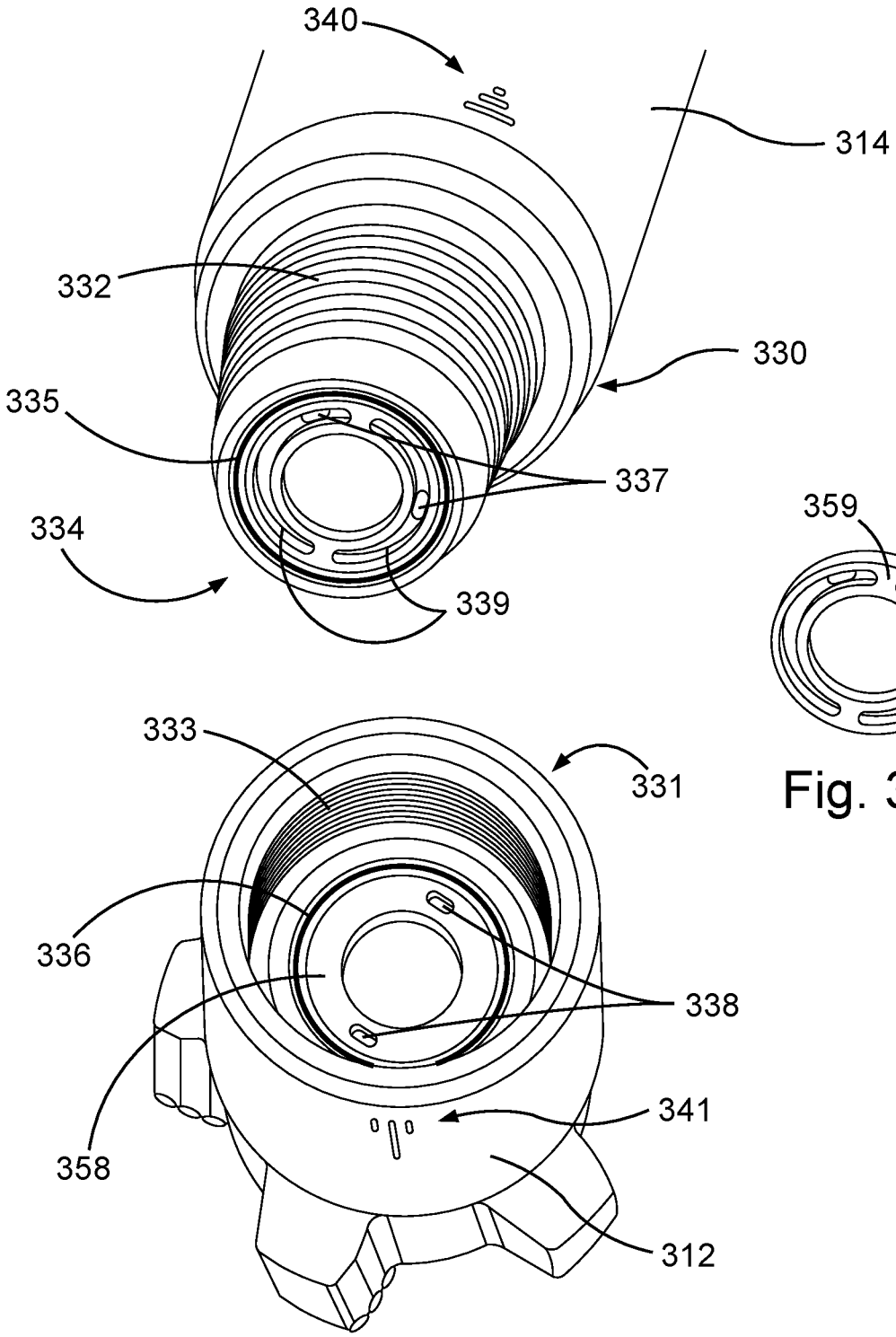
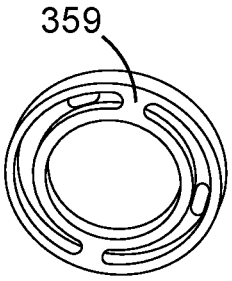
Fig. 3-1
Fig. 3

DOWNHOLE DRILL BIT CHASSIS

BACKGROUND

When exploring for or extracting subterranean resources, such as oil, gas, or geothermal energy, and in similar endeavors, it is common to form boreholes in the earth. Such boreholes may be formed by engaging the earth with a rotatable drill bit suspended by a drill string. For example, in an embodiment shown in FIG. 1, a drill bit 112 may be suspended from a derrick 113 by a drill string 114. While a land-based derrick is shown, water-based structures are also common. This drill string 114 may be formed from a plurality of drill pipe sections 115 fastened together end-to-end. In other embodiments a flexible tubing may be used. As the drill bit 112 is rotated, either at the derrick 113 or by a downhole motor, it may engage and degrade a subterranean formation 116 to form a borehole 111 therethrough. Drilling fluid may be passed along the drill string 114, through each of the drill pipe sections 115, and expelled at the drill bit 112 to cool and lubricate the drill bit 112 as well as carry loose debris to a surface of the borehole 111 through an annulus surrounding the drill string 114.

At times it may be desirable to take measurements or perform various functions at the drill bit 112. It is believed that certain measurements and functions are most effective when taken or performed as close as possible to an end of a drill bit. However, such drill bits often experience significant wear and damage, due to the harsh conditions experienced during drilling. Worn or damaged drill bits often require replacement which can be expensive and time consuming. Instrumenting drill bits to take measurements or perform functions may significantly add to replacement expense and complexity.

BRIEF DESCRIPTION

A drill bit assembly may comprise a chassis, separate from a drill bit, housed within a cavity of the drill bit. A drill string may be secured to the drill bit and retain the chassis within the cavity. The chassis may comprise two pairs of interfacing exchange surfaces, a first pair disposed between the chassis and the drill string and a second pair disposed between the chassis and the drill bit. Both of the first pair of interfacing exchange surfaces are annular in shape and fixed together independent of rotational orientation. The second pair of interfacing exchange surfaces are fixed together in a specific rotational orientation. These pairs of interfacing exchange surfaces may allow for various types of signals, such as electrical, hydraulic, optical or electromagnetic for example, to be exchanged and passed through the chassis or to electronics disposed on the chassis. These electronics may be disposed on an exterior of the chassis and contained within at least one pressure chamber formed between the exterior of the chassis and an interior of the drill bit. In such a configuration, instrumentation may be removed from one drill bit and inserted into another, and thus reused, when one drill bit becomes worn or damaged.

DRAWINGS

FIG. 3 is a perspective view of an embodiment of a disassembled drill bit assembly.

FIG. 3-1 is a perspective view of an embodiment of an interchangeable plate.

FIGS. 5-1 and 5-2 are perspective views of embodiments of chassis.

DETAILED DESCRIPTION

Figure 2:
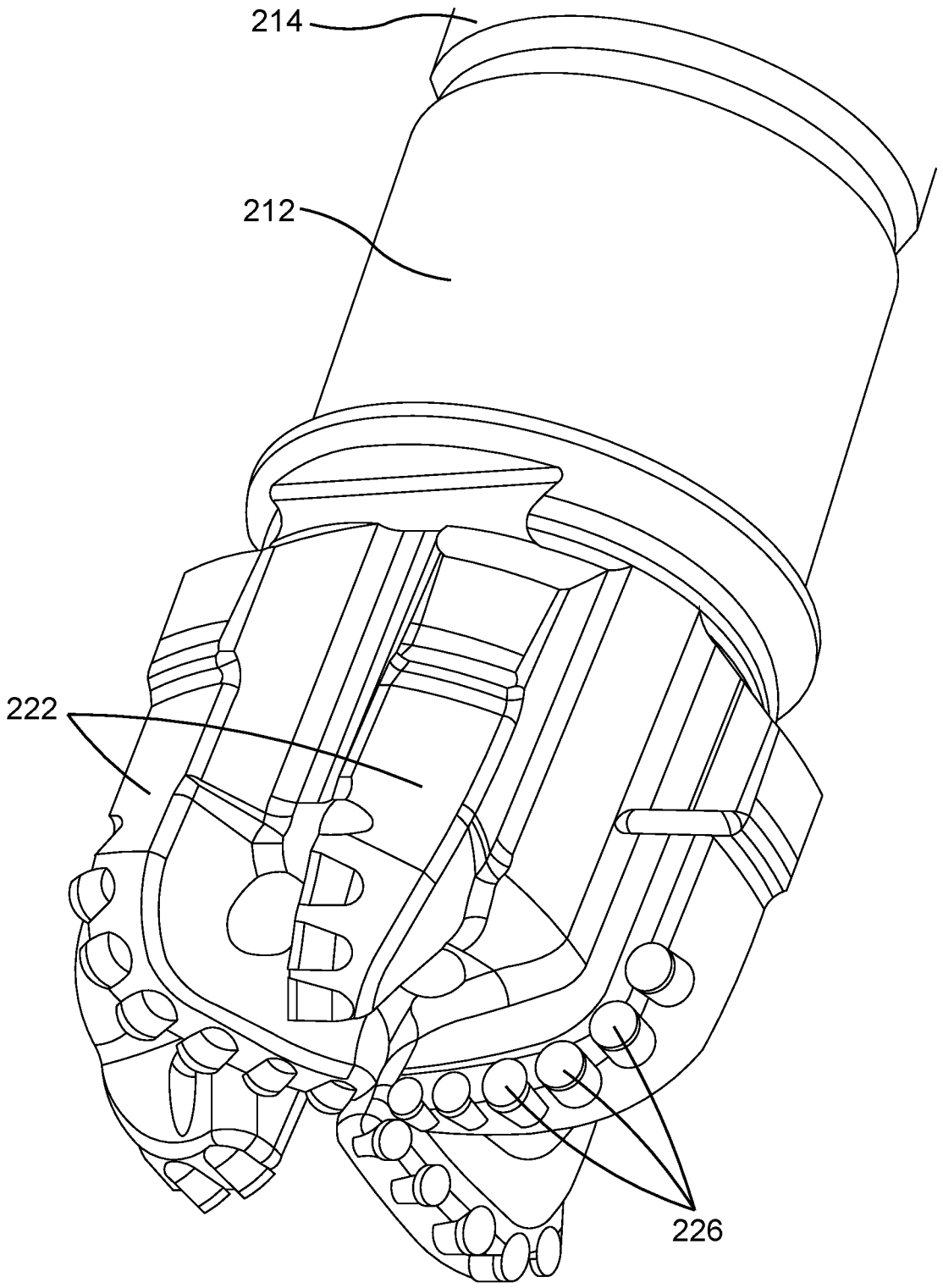
FIG. 2 is a perspective view of an embodiment of drill bit assembly.

FIG. 2 shows an embodiment of a downhole drill bit assembly comprising a drill bit 212 secured to an end of a drill string 214. The drill bit 212 may comprise a plurality of blades 222 protruding therefrom. These blades 222 may be generally spaced about a periphery of one end of the drill bit 212, opposite from the drill string 214, and comprise a plurality of tough cutter elements 226 attached to each of the blades 222 to aid in degrading hard earthen materials. While a fixed-bladed type drill bit is shown, a variety of other drill bit types could alternately be used.

FIG. 3 shows an embodiment of a downhole drill bit assembly that has been partially disassembled to highlight several features thereof. For example, a drill string 314 may comprise a protrusion 330 extending from one end thereof. This protrusion 330 may be inserted into a cavity 331 of a drill bit 312. In the embodiment shown, the protrusion 330 comprises a plurality of threads 332 disposed thereabout that may engage with comparable threads 333 formed on an internal surface of the cavity 331 to secure the protrusion 330 within the cavity 331. These threads 332 and 333 may comprise complementary geometries such that they cease relative rotation once the protrusion 330 arrives at a fixed position relative to the cavity 331. Various markings 340 and 341 exposed on exterior surfaces of the drill string 314 and drill bit 312, respectively, may also indicate relative alignment.

The protrusion 330 may comprise an interfacing exchange surface 334 disposed on a distal tip thereof. Various embodiments of interfacing exchange surfaces may allow for the exchange of electrical, hydraulic, optical and/or electromagnetic signals. In the embodiment shown, the interfacing exchange surface 334 is capable of exchanging power and data, via electricity and hydraulic fluid, with another interfacing exchange surface 358 housed within the cavity 331. Specifically, the interfacing exchange surface 334 comprises an inductive ring 335 that may sit adjacent another inductive ring 336 of the other interfacing exchange surface 358. While adjacent, electrical signals passing through the one inductive ring 335 may be communicated to the other inductive ring 336. These electrical signals may be passed regardless of rotational orientation of the drill string 314 relative to the drill bit 312.

As also shown in this embodiment, the interfacing exchange surface 334 comprises two ducts 337 exposed on the protrusion 330 that may conduct fluid into the cavity 331 and to two other ducts 338 exposed on the other interfacing exchange surface 358. These sets of two ducts 337 and 338 may allow for hydraulic power to be transmitted from the drill string 314 to the drill bit 312. Two nearly-semiannular grooves 339 may also be positioned on the interfacing exchange surface 334, one adjacent each of the two ducts 337 exposed thereon. These nearly-semiannular grooves 339 may allow fluid to flow therethrough from the two ducts 337 of the protrusion 330 to the two ducts 338 of the cavity 331 in a wide span of rotational orientations of the drill string 314 relative to the drill bit 312. Further, in the event that the span of possible rotational orientations is insufficient, a plate 359, as shown removed from the interfacing exchange surface 334 in FIG. 3-1, forming the nearly-semiannular grooves 339 could be exchanged with one comprising offset grooves to adjust the relative positions. As can be seen, only one of a pair of interfacing exchange surfaces needs such grooves for this type of rotationally independent fluid transfer.

Figure 4:
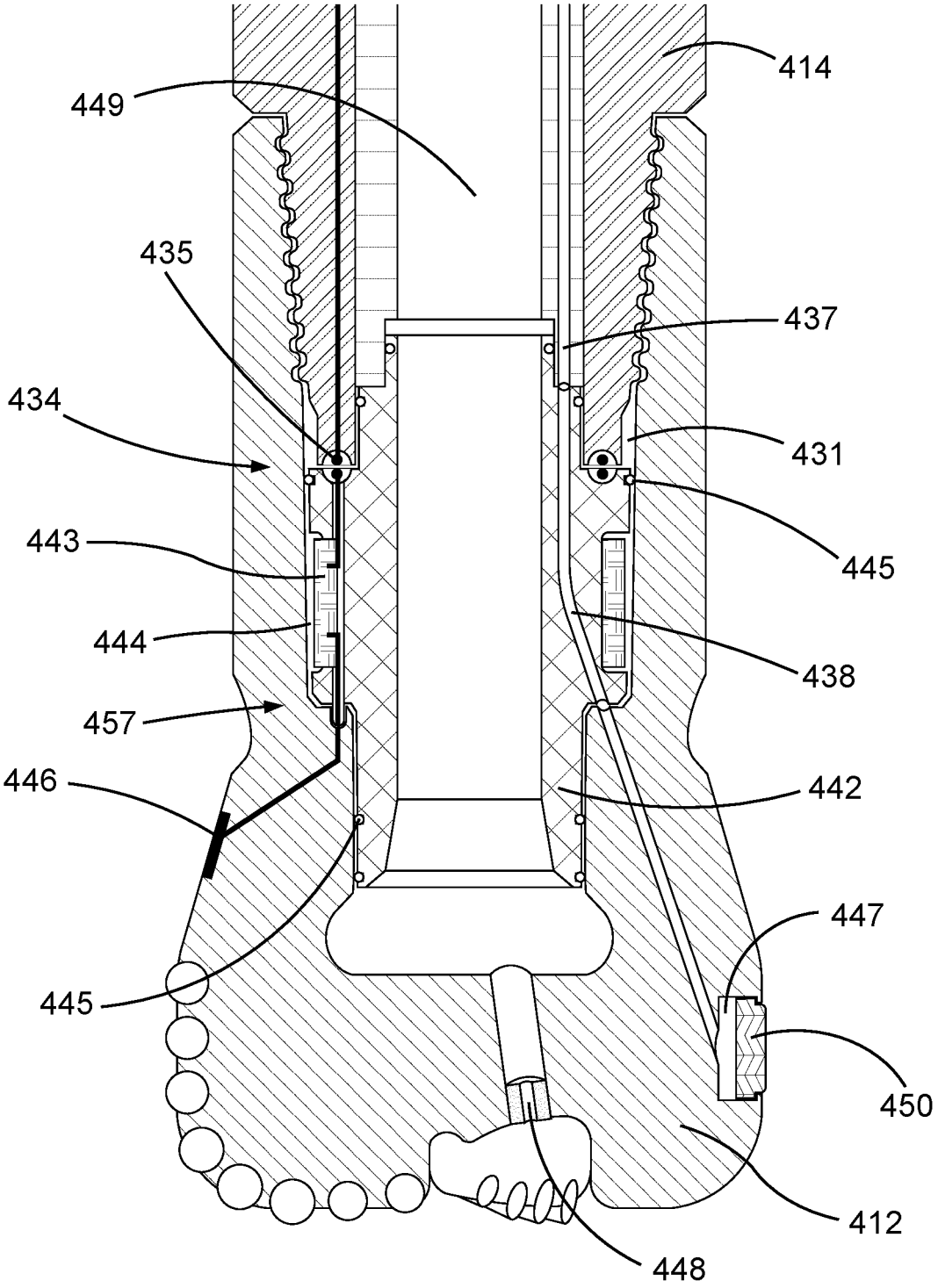
FIG. 4 is a longitude-sectional view of an embodiment of drill bit assembly.

FIG. 4 shows another embodiment of a downhole drill bit assembly. As can be seen, a chassis 442, comprising a body separate from a drill bit 412, may be disposed within a cavity 431 of the drill bit 412. A drill string 414 may be threaded into the cavity 431 and retain the chassis 442 therein. If the drill string 414 were to be unthreaded, the chassis 442 could be removed from the cavity 431 and inserted into a different drill bit. This may be advantageous if the drill bit 412 becomes worn or damaged. Both the drill string 414 and the chassis 442 may comprise a fluid channel 449 passing therethrough allowing drilling fluid traveling through the drill string 414 to exit through at least one nozzle 448 of the drill bit 412.

The drill string 414 may connect to the chassis 442 via a pair of interfacing exchange surfaces 434, similar to those described previously. In this embodiment, the interfacing exchange surfaces 434 allow for exchange of electricity and hydraulic fluids. For example, a pair of inductive rings 435 may allow for exchanging electrical signals between the drill string 414 and the chassis 442. These electrical signals may be passed to electronics 443 disposed on an exterior surface of the chassis 442. These electronics 443 may be housed within a pressure chamber 444 formed between the chassis 442, the cavity 431 of the drill bit 412, and pressure seals 445 disposed on either side of the electronics 443.

The electronics 443 may receive additional electrical signals from a sensor 446, capable of sensing characteristics of a surrounding borehole or parameters of an associated drilling operation, positioned on an exterior surface of the drill bit 412. It is believed that positioning certain types of sensors as close as possible to an end of a drill bit may be advantageous.

In another example, a fluid duct 437 may allow fluid to flow from the drill string 414 into another duct 438 within the chassis 442. This flow may be possible regardless of rotational positioning of the drill string 414 relative to the chassis 442. This other duct 438 may pass completely through the chassis 442 and conduct fluid to a cavity 447 within the drill bit 412. As the cavity 447 is filled, a piston 450 may be forced by fluid pressure within the cavity 447 to extend from an exterior of the drill bit 412.

In the embodiment shown, electrical and hydraulic interfacing exchange surfaces 457 between the chassis 442 and the drill bit 412 may be fixed together in a specific rotational orientation such that they rotate together. As can be seen, one of these interfacing exchange surfaces 457 may connect through the chassis 442 to one of the other interfacing exchange surfaces 434 described previously. Additionally, in the case of the electrical connection, the electronics 443 may be connected to one or both of the interfacing exchange surfaces 434, 457.

Figure 1:
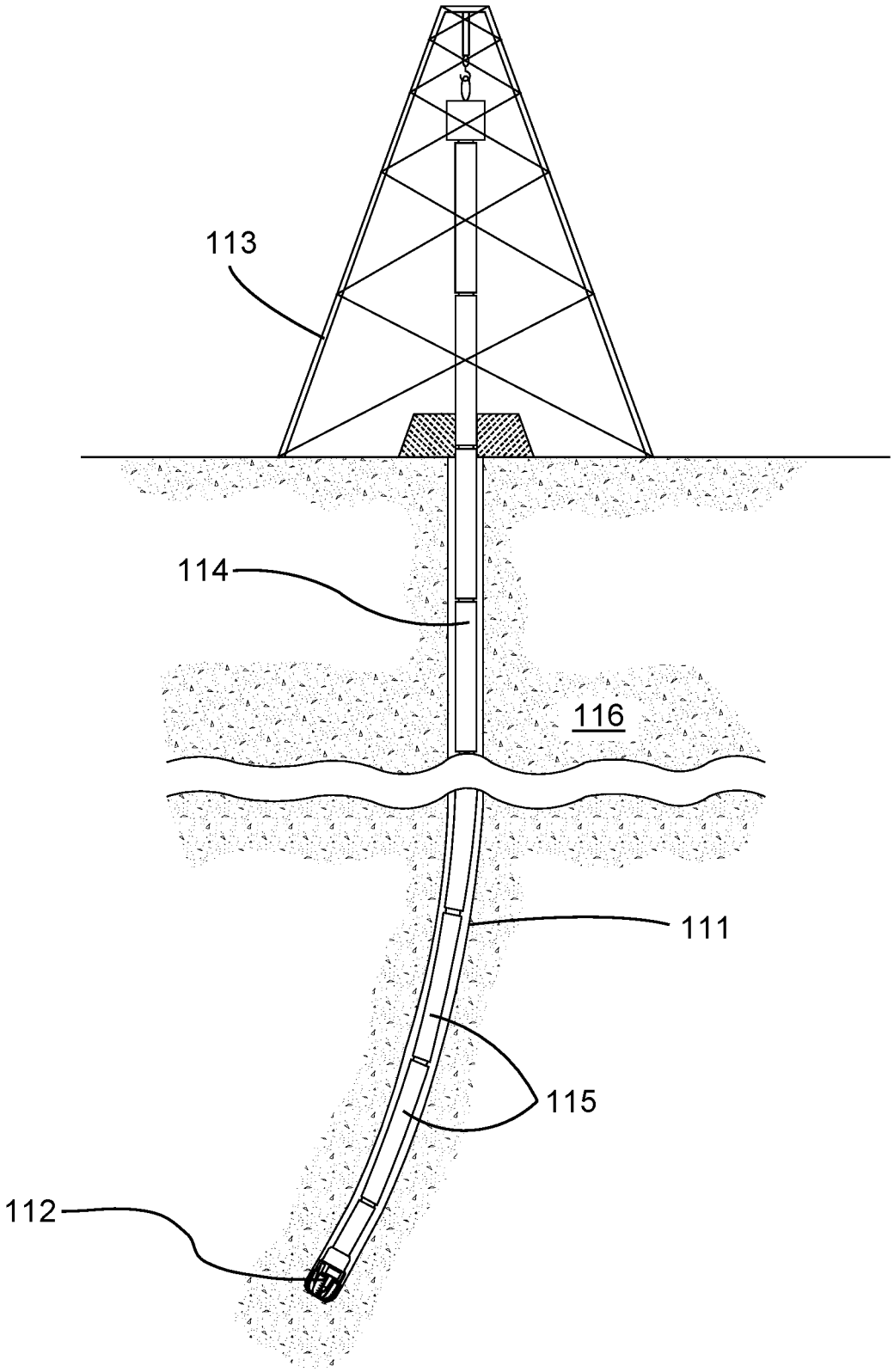
FIG. 1 is an orthogonal view of an embodiment of a drilling operation comprising a drill bit secured to an end of a drill string suspended from a derrick.
Figures 1, 5:
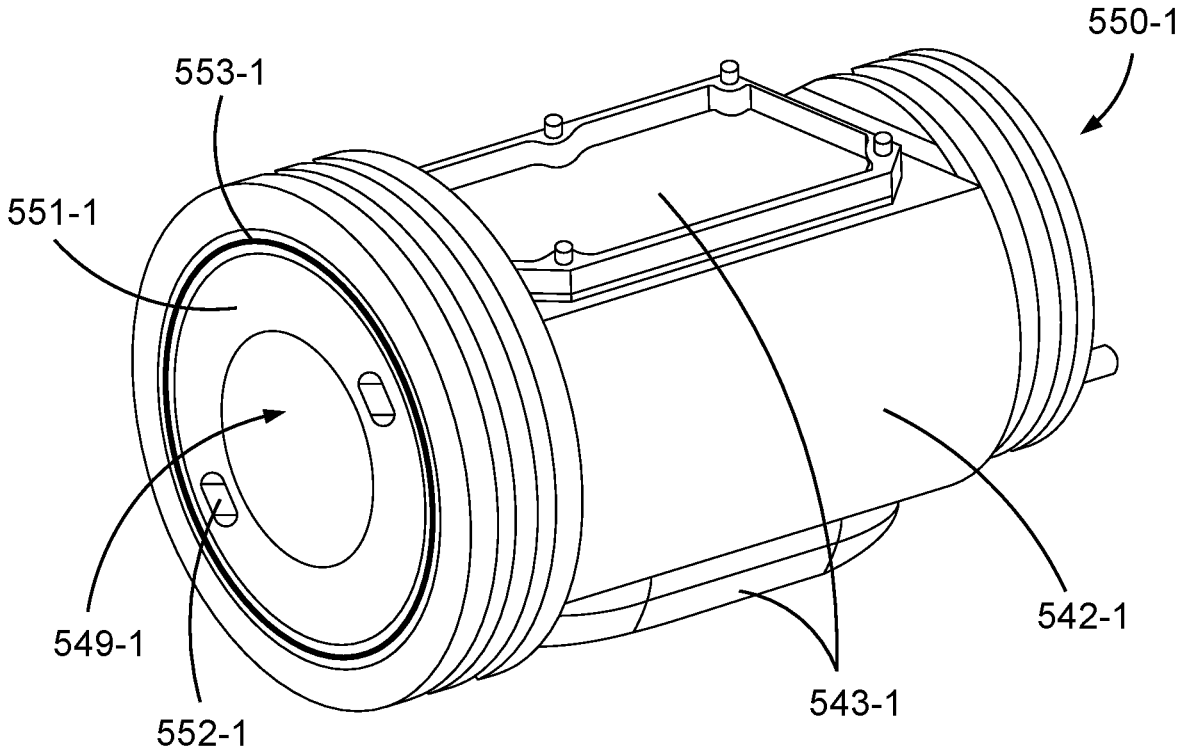
Figures 2, 5:
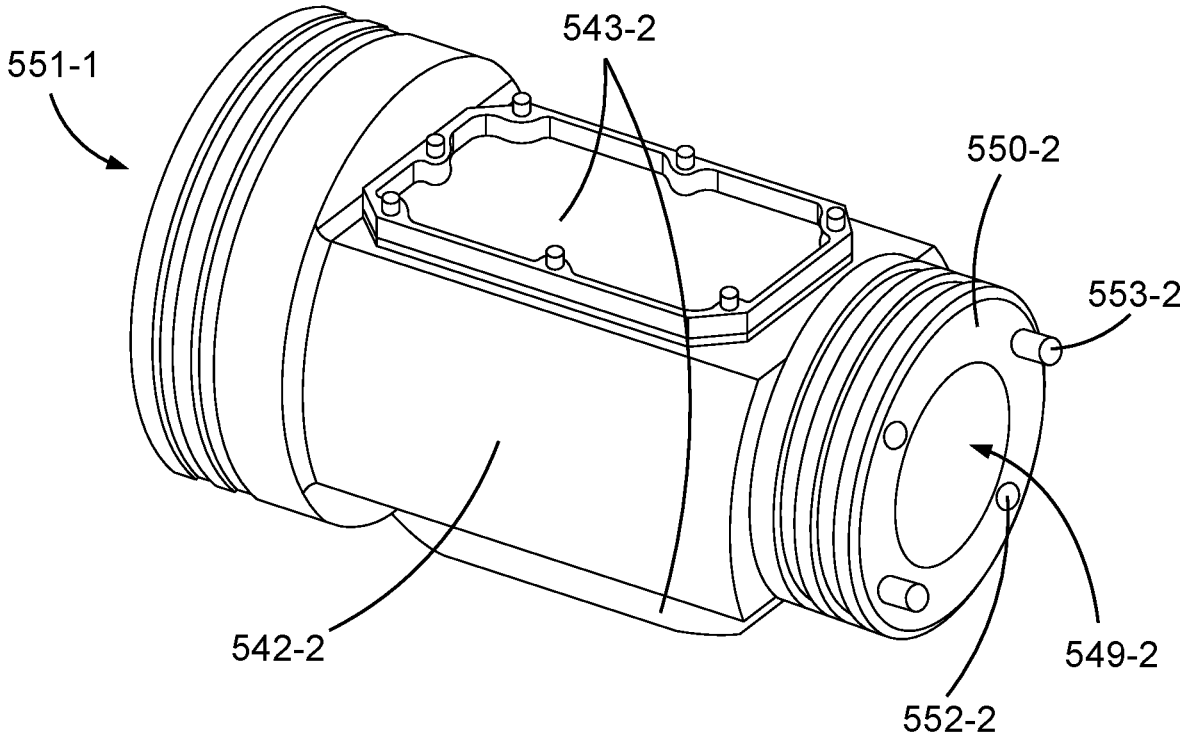

FIGS. 5-1 and 5-2 show embodiments of chassis 542-1, 542-2. These chassis 542-1, 542-2 may be generally tubular shaped with a fluid channel 549-1, 549-2 passing therethrough. These chassis 549-1, 549-2 may also comprise various electronics 543-1, 543-2 disposed circumferentially about an exterior surface thereof. An interfacing exchange surface may be disposed on either end of the chassis 542-1, 542-2. Specifically, a first interfacing exchange surface 551-1, 551-2, providing for a connection independent of rotational orientation, may be disposed on one end of the respective chassis 542-1, 542-2 and a second interfacing exchange surface 550-1, 550-2, providing for a connection of specific rotational orientation, may be disposed on an opposite end thereof. The first interfacing exchange surface 551-1 may comprise ducts 552-1 for hydraulic exchange and an inductive ring 553-1 for electrical exchange. The second interfacing exchange surface 550-2 may comprise ducts 552-2 for hydraulic exchange and a stab connection 553-2 for electrical exchange.

Whereas the preceding has been described in particular relation to the figures attached hereto, it should be understood that other and further modifications apart from those shown or suggested herein, may be made within the scope and spirit of the present invention.

The invention claimed is:

1. A downhole drill bit assembly, comprising:

a drill string secured to a drill bit;

a chassis housed within a cavity of the drill bit; wherein the drill string comprises a protrusion inserted into the cavity;

a first pair of interfacing exchange surfaces, between the chassis and the drill string, are both annular and fixed together independent of rotational orientation; wherein one of the first pair of interfacing exchange surfaces is disposed on an end of the protrusion; and a second pair of interfacing exchange surfaces, between the chassis and the drill bit, are fixed together in a specific rotational orientation.

2. The downhole drill bit assembly of claim 1, wherein the first and second pairs of interfacing exchange surfaces are capable of exchanging at least one of electrical, hydraulic, optical and electromagnetic signals.

3. The downhole drill bit assembly of claim 1, wherein the protrusion retains the chassis within the cavity.

4. The downhole drill bit assembly of claim 3, wherein the protrusion is secured within the cavity via threads that cease rotation at a fixed position.

5. The downhole drill bit assembly of claim 1, wherein the chassis is removable from the cavity.

6. The downhole drill bit assembly of claim 5, wherein the chassis is insertable into a different drill bit.

7. The downhole drill bit assembly of claim 1, wherein one of the first pair of interfacing exchange surfaces is connected to one of the second pair of interfacing exchange surfaces through the chassis.

8. The downhole drill bit assembly of claim 1, wherein the chassis comprises electronics disposed on an exterior surface thereof.

9. The downhole drill bit assembly of claim 8, wherein the chassis comprises electronics disposed circumferentially about the exterior surface thereof.

10. The downhole drill bit assembly of claim 8, wherein the electronics are connected to at least one of the first and second pairs of interfacing exchange surfaces.

11. The downhole drill bit assembly of claim 8, further comprising pressure seals, disposed on either side of the electronics, forming a pressure chamber between the exterior surface of the chassis and an internal surface of the cavity.

12. The downhole drill bit assembly of claim 1, wherein the first pair of interfacing exchange surfaces comprises two inductive rings, one disposed on each of the chassis and the drill string.

13. The downhole drill bit assembly of claim 1, wherein the first pair of interfacing exchange surfaces comprises four ducts, two exposed on each of the chassis and the drill string.

14. The downhole drill bit assembly of claim 13, wherein at least one of the first pair of interfacing exchange surfaces comprise two nearly-semiannular grooves, one adjoining each of the two ducts exposed thereon.

15. The downhole drill bit assembly of claim 14, wherein each of the two ducts of the chassis or the drill string not comprising the nearly-semiannular grooves are aligned with a unique one of the nearly-semiannular grooves.

16. The downhole drill bit assembly of claim 1, wherein the second pair of interfacing exchange surfaces comprises a stab connector.

17. The downhole drill bit assembly of claim 1, further comprising a fluid channel passing through the drill string and the chassis.

18. The downhole drill bit assembly of claim 1, wherein the drill bit and drill string comprise markings on exterior surfaces thereof indicating relative alignment.

19. The downhole drill bit assembly of claim 18, wherein at least one of the second pair of interfacing exchange surfaces comprises an interchangeable plate.

* * * * *